US005960755A

United States Patent [19]

Diggs et al.

[11] Patent Number: 5,960,755

[45] Date of Patent: Oct. 5, 1999

[54] INTERNAL COMBUSTION ENGINE WITH VARIABLE CAMSHAFT TIMING AND VARIABLE DURATION EXHAUST EVENT

[75] Inventors: Matthew Byrne Diggs, Farmington; Aladar Otto Simko, Dearborn Heights; Robert Albert Stein, Saline, all of Mich.

[73] Assignee: Ford Global Technologies, Inc., Dearborn, Mich.

[21] Appl. No.: 09/094,377

[22] Filed: Jun. 9, 1998

[51] Int. Cl.[6] ..... F01L 13/00; F02B 47/08

[52] U.S. Cl. ..... 123/90.15; 123/90.16; 123/90.17; 123/90.23; 123/568.14

[58] Field of Search ..... 123/90.15, 90.16, 123/90.17, 90.22, 90.23, 568.11, 568.14

[56] References Cited

U.S. PATENT DOCUMENTS

| | | | |
|---|---|---|---|
| 2,183,674 | 12/1939 | Erren . | |
| 3,441,009 | 4/1969 | Rafanelli . | |
| 4,285,310 | 8/1981 | Takizawa et al. . | |
| 4,327,676 | 5/1982 | McIntire et al. . | |
| 4,344,393 | 8/1982 | Etoh et al. . | |
| 4,365,597 | 12/1982 | Iizuka et al. . | |
| 4,401,069 | 8/1983 | Foley . | |
| 4,494,504 | 1/1985 | Yagi et al. . | |
| 4,499,870 | 2/1985 | Aoyama . | |
| 4,516,542 | 5/1985 | Aoyama et al. . | |
| 4,520,775 | 6/1985 | Nakamura . | |
| 4,522,179 | 6/1985 | Nishimura et al. . | |
| 4,534,323 | 8/1985 | Kato et al. . | |
| 4,552,112 | 11/1985 | Nagao et al. . | |
| 4,570,590 | 2/1986 | Kawai et al. . | |
| 4,584,974 | 4/1986 | Aoyama et al. . | |
| 4,667,636 | 5/1987 | Oishi et al. . | |
| 4,702,207 | 10/1987 | Hatamura et al. . | |
| 4,873,949 | 10/1989 | Fujiyoshi et al. | 123/90.12 |
| 4,911,113 | 3/1990 | Yamada . | |
| 4,932,377 | 6/1990 | Lyle . | |
| 4,932,378 | 6/1990 | Hitomi et al. . | |
| 4,974,566 | 12/1990 | LoRusso et al. . | |
| 5,031,583 | 7/1991 | Konno | 123/90.16 |
| 5,101,778 | 4/1992 | Fukuo et al. | 123/90.27 |
| 5,119,784 | 6/1992 | Hashimoto et al. . | |
| 5,133,310 | 7/1992 | Hitomi et al. . | |
| 5,165,374 | 11/1992 | Chapman et al. . | |
| 5,190,013 | 3/1993 | Dozier . | |
| 5,228,422 | 7/1993 | Wakeman . | |
| 5,230,320 | 7/1993 | Hitomi et al. . | |

(List continued on next page.)

FOREIGN PATENT DOCUMENTS

| | | |
|---|---|---|
| 0105934 | 4/1984 | European Pat. Off. . |
| 0 724 067 | 7/1996 | European Pat. Off. . |
| 0 777 038 | 6/1997 | European Pat. Off. . |
| 52-34108 | 3/1977 | Japan . |
| 55-32976 | 3/1980 | Japan . |
| 55-109724 | 8/1980 | Japan . |
| 57-183553 | 11/1982 | Japan . |
| 58-124019 | 7/1983 | Japan . |
| 58-148230 | 9/1983 | Japan . |
| 60-11206 | 3/1985 | Japan . |
| 60-85222 | 5/1985 | Japan . |
| 61-12940 | 1/1986 | Japan . |
| 61-49121 | 3/1986 | Japan . |
| 2-230920 | 9/1990 | Japan . |
| 3-202619 | 9/1991 | Japan . |

OTHER PUBLICATIONS

Dual Equal VCT–A Variable Camshaft Timing Strategy for Improved Fuel Economy and Emissions, SAE Technical Paper Series 950975, p 1–13, R. Stein, K. Galietti and T. Leone, Mar. 1995.

*Primary Examiner*—Weilun Lo
*Attorney, Agent, or Firm*—Jerome R. Drouillard

[57] ABSTRACT

A reciprocating four-stroke internal combustion engine includes a variable exhaust valve operating system for changing the duration of an exhaust valve opening event and also a camshaft drive for rotating a valve operating camshaft and adjusting the rotational timing of the camshaft with respect to the crankshaft.

15 Claims, 3 Drawing Sheets

U.S. PATENT DOCUMENTS

| | | | |
|---|---|---|---|
| 5,236,332 | 8/1993 | Satou et al. . | |
| 5,239,960 | 8/1993 | Sasaki et al. . | |
| 5,359,972 | 11/1994 | Isaka . | |
| 5,408,966 | 4/1995 | Lipinski et al. . | |
| 5,443,050 | 8/1995 | Hitomi et al. . | |
| 5,467,748 | 11/1995 | Stockhausen . | |
| 5,487,365 | 1/1996 | Isaka . | |
| 5,497,737 | 3/1996 | Nakamura | 123/90.15 |
| 5,544,626 | 8/1996 | Diggs et al. . | |
| 5,606,960 | 3/1997 | Takahashi et al. . | |
| 5,642,703 | 7/1997 | Stockhausen et al. . | |
| 5,653,198 | 8/1997 | Diggs . | |
| 5,657,726 | 8/1997 | Diggs . | |
| 5,669,341 | 9/1997 | Ushirono et al. . | |
| 5,803,029 | 9/1998 | Yoshihara et al. | 123/90.16 |
| 5,806,476 | 9/1998 | H.ang.kansson | 123/90.17 |

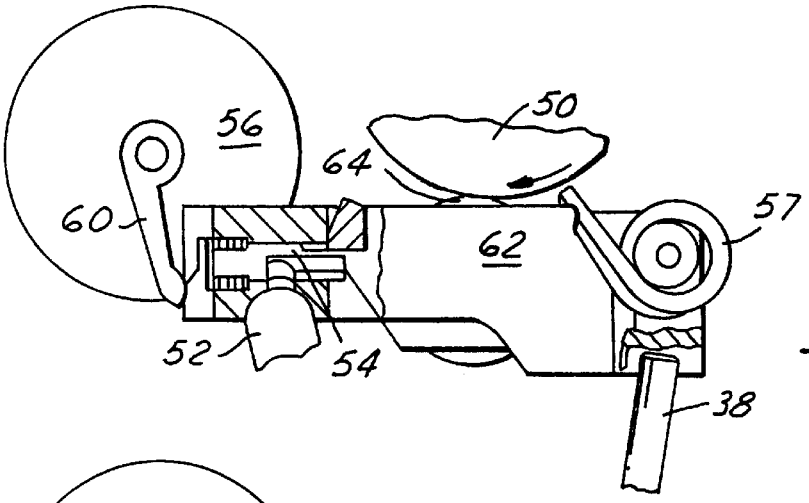
FIG.5
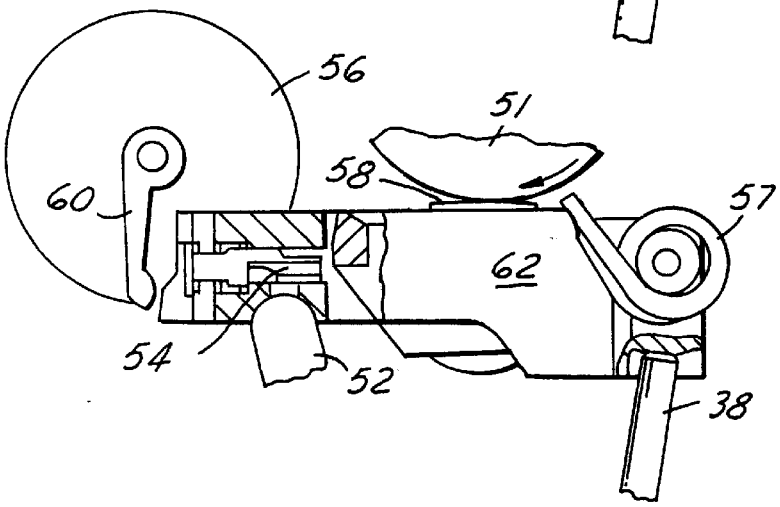
FIG.6
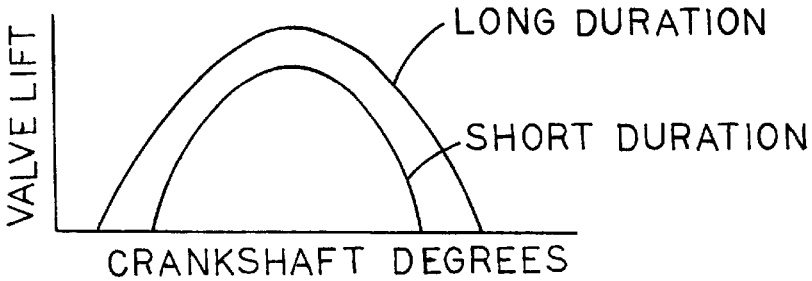
FIG.7
FIG.8
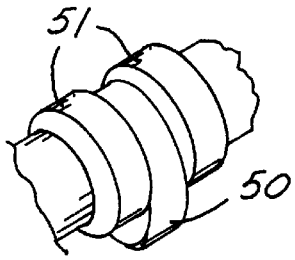

INTERNAL COMBUSTION ENGINE WITH VARIABLE CAMSHAFT TIMING AND VARIABLE DURATION EXHAUST EVENT

TECHNICAL FIELD

The present invention relates to an internal combustion engine having variable camshaft timing for the intake and exhaust valves and having a variable duration exhaust event overlaid upon the variable camshaft timing.

BACKGROUND INFORMATION

Designers of automotive reciprocating internal combustion engines having understood for years that it is possible to control oxides of nitrogen through the use of exhaust gas recirculation (EGR). Most EGR systems have, however, been external. In other words, exhaust gas has been conducted from the exhaust manifold and into the engine through the intake manifold. Unfortunately, this scheme does not provide for very good control of EGR, particularly in engines in which higher manifold pressures are the rule, such as turbocharged and other types of boosted engines. In any event, high rates of EGR are difficult to manage even with naturally aspirated engines because combustion stability typically degrades rapidly with increasing EGR rate.

The present invention allows EGR to be managed internally through dual equal camshaft phase shifting while providing additional benefit of a variable duration exhaust event. The camshaft timing control allows heavy EGR, with concomitant benefits in terms of reduced oxides of nitrogen (NOx), and also decreased fuel consumption matched with excellent combustion stability. Dual or variable duration exhaust event provides an additional benefit inasmuch as the engine may be operated with retarded timing and a short exhaust event at light loads and low speeds, or with a short exhaust event and base timing at cold conditions and at low speed, wide open throttle operation. At high engine speeds, the camshaft may be operated at base timing with a longer duration exhaust event to provide increased engine power output. Additionally, the dual duration exhaust event allows better optimization of the timing of exhaust valve opening, which improves engine torque output at lower speeds.

SUMMARY OF THE INVENTION

A reciprocating four-stroke cycle internal combustion engine has a cylinder block with at least one cylinder, a piston, a crankshaft, a connecting rod joining the piston and the crankshaft, an intake manifold, and an intake and exhaust poppet valves servicing the cylinder. The engine further includes a cylinder head mounted upon the cylinder block so as to close the cylinder, and a camshaft for actuating the intake and exhaust valves. The camshaft is driven by a camshaft drive which rotates the camshaft and which adjusts the rotational timing of the camshaft with respect to the crankshaft. In other words, the engine has a variable cam timing device. The camshaft has a base timing from which the timing may be retarded.

According to another aspect of the present invention, a variable exhaust valve operating system changes the duration of exhaust valve opening independently of camshaft timing. Finally, a controller operates the camshaft drive and exhaust valve operating system so as to control both the timing of the camshaft in a continuously variable fashion, and duration of the exhaust valve opening as one of two modes.

The engine controller may operate the camshaft drive and exhaust valve operating system such that the camshaft timing will generally be retarded at lower to medium engine loads and the exhaust valve will be operated with a relatively shorter duration at lower engine speeds and with a relatively longer duration at higher engine speeds.

An engine according to the present invention may further include a charge motion control valve which modifies the angular momentum of charge entering the cylinder, or a pilot mask which directs flow past the intake valve until the intake valve has opened to an extent greater than about 30–40% of its total lift.

According to another aspect of the present invention, a method for operating a reciprocating four-stroke cycle internal combustion engine having a cylinder block with at least one cylinder and other mechanical attributes according to the engine described above, includes the steps of sensing a plurality of engine operating parameters including at least engine speed, determining engine load, and controlling camshaft timing and exhaust valve duration in response to the values of the sensed engine parameters and the determined engine load, so as to control the residual fraction of exhaust gas within the engine cylinder. According to this method, the camshaft's timing may be retarded at light and medium loads and advanced at full load during low speed operation and slightly retarded at full load, high speed operation. And, the exhaust valve may be operated with a longer or shorter duration at any engine speed and at any degree of camshaft timing retard. In a preferred embodiment, the exhaust valves will be operated with a shorter duration at lower engine speeds and with longer duration at higher engine speeds. As used herein, the term low speed generally means engine speeds below approximately 3000 rpm. Thus, high speed means engine speeds generally above 3000 rpm. Low load means engine loads below about 2 bar BMEP. Medium load means engine loads between 2 and 6 bar BMEP. Finally, high load means loads above 6 bar to and including wide open throttle.

It is an advantage of the present invention that an engine having a system according to this invention may be operated with very low feed gas levels of NOx, excellent fuel economy, and excellent combustion stability. As used herein, the term "feed gas" means the gases leaving the engine prior to being treated by any sort of aftertreatment device.

Another advantage of the present invention resides in the fact that an engine constructed and operated according to this invention will exhibit not only low NOx but also excellent warm-up characteristics as made available by the variable exhaust valve duration system.

Other advantages, as well as objects and features of the present invention will become apparent to the reader of this specification.

BRIEF DESCRIPTION OF THE DRAWINGS

FIG. 5 illustrates the valve follower of FIG. 2 in a long duration operating mode.

FIG. 6 illustrates the valve follower of FIG. 2 in a short duration operating mode.

FIG. 7 illustrates the valve opening characteristics of a valve operating mechanism according to FIGS. 2 and 5–6.

FIG. 8 illustrates three cam lobes employed for operating each exhaust valve according to one aspect of the present invention.

DETAILED DESCRIPTION OF PREFERRED EMBODIMENTS

Figure 1:
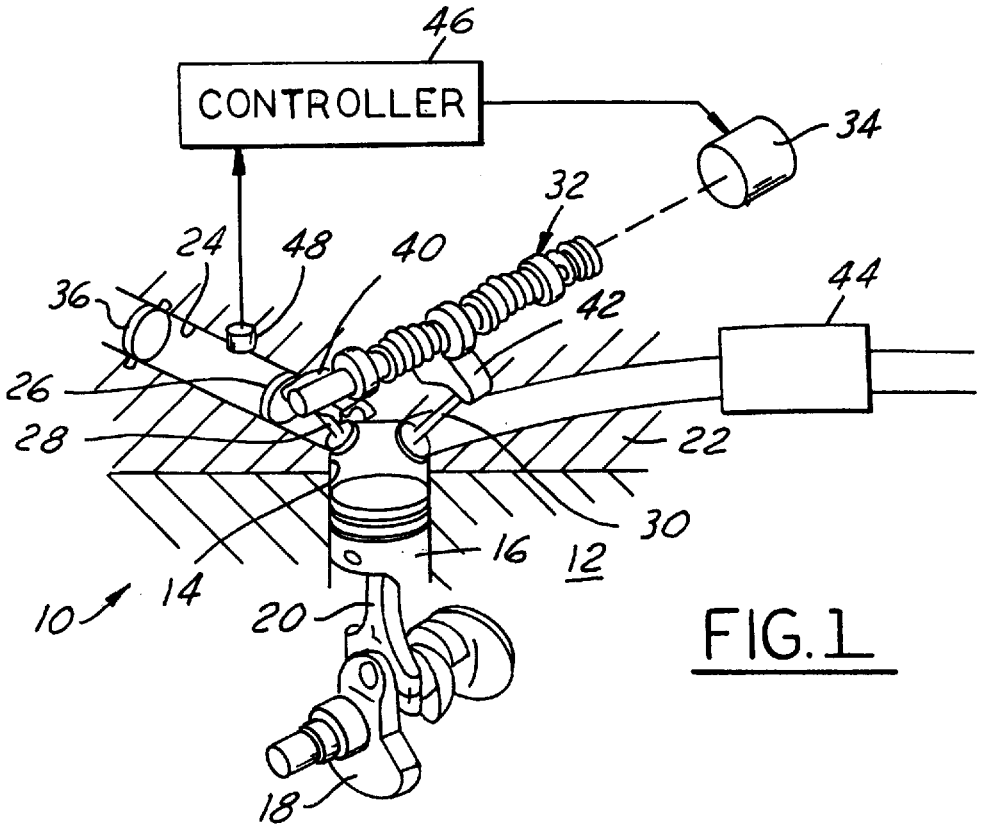
FIG. 1 is a schematic representation of an engine having variable camshaft timing and variable duration exhaust event according to the present invention.

As shown in FIG. 1, engine 10 includes cylinder block 12, having cylinder 14, with piston 16 mounted reciprocably therein. Connecting rod 20 joins piston 14 and crankshaft 18. Air is provided to the engine by means of intake manifold 24 which has charge motion control valve (CMCV) 26 mounted therein. The purpose of CMCV 26 is to selectively increase the angular momentum of charge entering cylinder 14. Those skilled in the art will appreciate in view of this disclosure, however, that an engine may be built according to the present invention without having CMCV 26.

Intake air is admitted into cylinder 14 by means of intake valve 28 which is actuated by means of intake follower 40 and camshaft 32. Camshaft drive 34 rotates camshaft 32 and times camshaft 32 with respect to crankshaft 18. Those skilled in the art will appreciate in view of this disclosure that camshaft drive 34 could comprise any one of a number of camshaft driving mechanisms known to those skilled in the art and suggested by this disclosure. Such mechanisms include mechanical, electrical, hydromechanical, and other types of variable speed and variable phase drives known to those skilled in the art.

Camshaft drive 34 will be used according to the present invention to controllably retard the camshaft timing in response to commands from engine controller 46. The extent of the retarded timing and operation of camshaft drive 34 is illustrated in FIG. 4 which will be discussed below.

Figure 2:
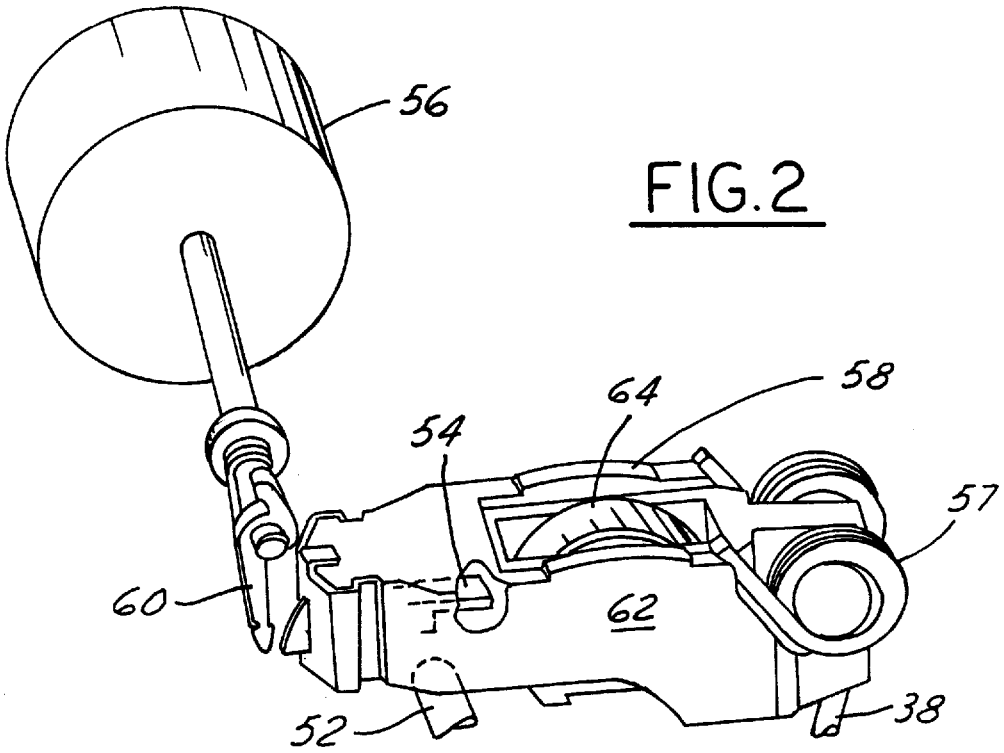
FIG. 2 illustrates a mechanism for providing a variable duration exhaust event according to the present invention. This device is similar to a valve operator disclosed in U.S. Pat. No. 5,653,198, which is hereby incorporated by reference into this specification.

Exhaust follower 42, which is illustrated with greater detail in FIGS. 2 and 5–6, provides a variable duration exhaust event. This is important because, for example, with a short duration exhaust event during cold start there is less valve overlap which in effect results in early exhaust valve closing, which improves idle quality. Also, with a short exhaust valve event, relatively late exhaust valve opening occurs and this assists the in-cylinder oxidation of hydrocarbons before the gases pass into the exhaust port past exhaust valve 30. FIG. 7 is a plot of valve opening as a function of crankshaft position for exhaust follower 42. With short duration operation, exhaust valve 30 will open later and close earlier than during operation in the longer duration mode. And, the extent of the valve's opening is reduced during the shorter duration event. The short duration camshaft lobes are shown in FIG. 8 as cam lobes 51; the single long duration lobe is shown as lobe 50.

Exhaust follower 42 provides variable duration for the exhaust valve event, with the duration being independently controllable over the camshaft timing. As shown in FIG. 2, exhaust follower 42 has follower finger 58, which is hinged within outer body 62, which bears upon stem 38 of exhaust valve 30. As shown more fully in FIGS. 5 and 6, follower finger 58 may be selectively locked to outer body 62, by means of locking pin 54. Solenoid motor 56 rotates arm 60 so as to push locking pin 54 axially into outer body 62 and into the position shown in FIG. 5.

When exhaust follower 42 is in the mode or position illustrated in FIG. 5, cam lobe 50, which is the long duration lobe, bears upon roller 64. In this mode, neither of cam lobes 51 contact follower 42. When however, solenoid motor 56 is not energized, locking pin 54 will be positioned as shown in FIG. 6. As a result, follower finger 58 will merely ratchet back and forth, while winding and unwinding torsion spring 57, and cam lobes 51 will be free to ride directly on pads 63, which are integral with outer body 62, so as to produce the short duration event illustrated in FIG. 7.

Figure 3:
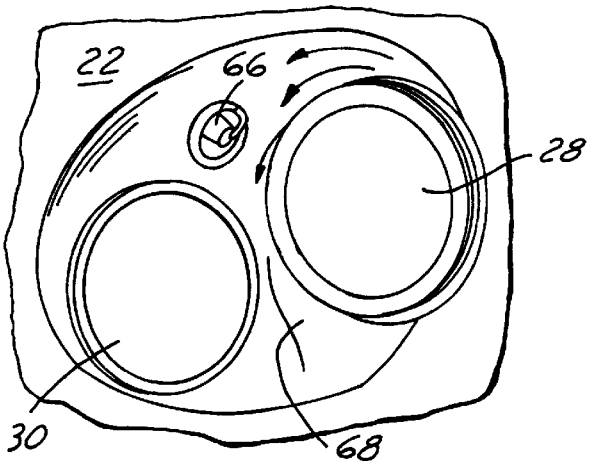
FIG. 3 illustrates a pilot mask applied to a cylinder head according to an aspect of the present invention.

FIG. 3 illustrates a pilot mask according to another aspect of the present invention. Cylinder head 22 having spark plug 66, exhaust valve 30, and intake valve 28 has mask 68 which in essence forms a cylindrical enclosure about a portion approximating 180° of rotation of intake valve 28. The purpose of pilot mask 68 is to provide directional control of air entering cylinder 14 until intake valve has opened to an extent greater than 30–40% of its total lift. In this manner, the charge motion will be greatly increased and allow a much higher level of EGR to be employed with the present invention. As with the CMCV, an engine may be built and operated according to an aspect of the present invention without a pilot mask. This is so because not all engines require the enhanced charge motion offered by the pilot mask and the CMCV.

Gases leaving engine 10 pass through aftertreatment device 44, which may comprise either a three-way catalyst, an oxidizing catalyst, or a NOx trap, or combinations of these devices known to those skilled in the art and suggested by this disclosure. Device 44 may further comprise other types of devices such as thermal reactors.

According to another aspect of the present invention, a method for operating this engine includes sensing a plurality of engine operating parameters, including at least engine speed, and determining engine load. For this purpose, intake manifold pressure sensor 48 and other sensors, known to those skilled in the art and suggested by this disclosure, are operatively connected with controller 46, which determines engine load according to any one of a plethora of processes well known to those skilled in the art. The determined load, and if desired, other operating parameters such as engine speed, are employed for controlling the residual fraction of exhaust gas within the engine cylinder. The control scheme is discussed below in connection with FIG. 4.

FIG. 4 illustrates four different combinations of exhaust valve duration and camshaft timing. Each of FIGS. 4A–4D illustrates approximate valve timings; those skilled in the art will appreciate in view of this disclosure that these timings will be selected according to such factors as the number of poppet valves and other factors. As used in FIGS. 4A–4D, the term TDC means "Top Dead Center" and the term BDC means "Bottom Dead Center". The term EVO means "Exhaust Valve Opening", and the term EVC means "Exhaust Valve Closing". Finally, the term IVO means "Intake Valve Opening" and the term IVC means "Intake Valve Closing".

Figure 4A:
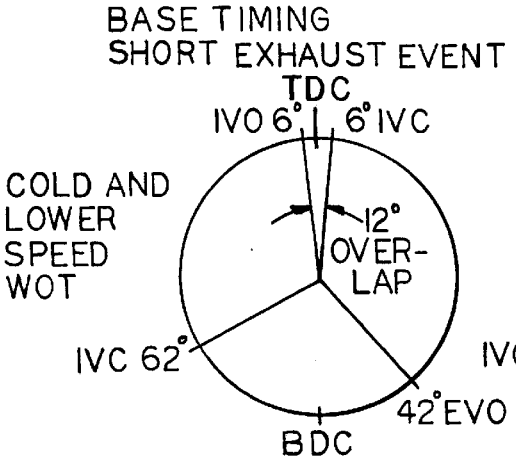
FIGS. 4A–4D include four different timing diagrams which illustrate combinations of variable duration exhaust event and camshaft timing according to the present invention.
Figure 4B:
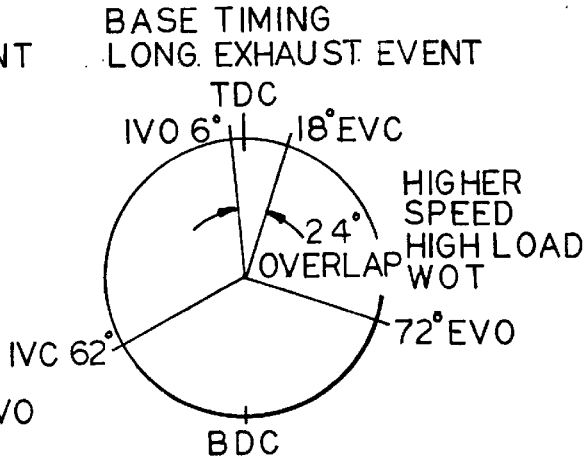
Figure 4C:
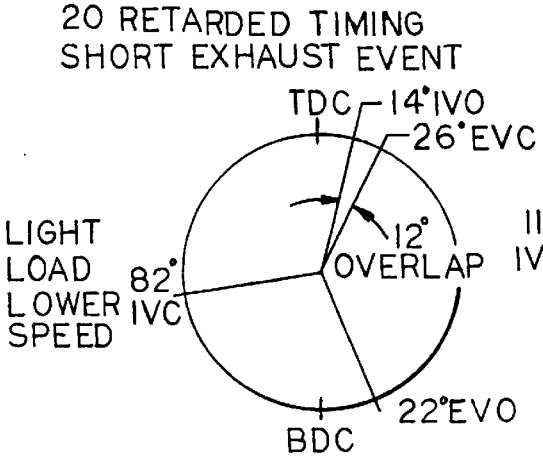
Figure 4D:
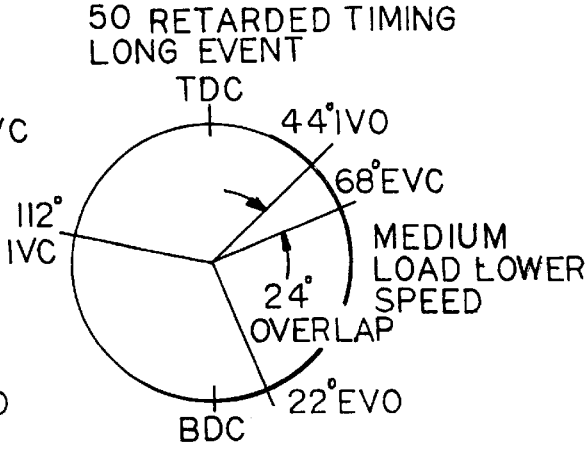

FIG. 4A illustrates the case of base timing (i.e., no camshaft retard) coupled with a short exhaust valve event. The timing of FIG. 4A could be used when the engine is cold or at low speeds when the engine is at high to maximum load. A short exhaust event with only 12° of overlap between IVO and EVC will promote good idle quality, while avoiding problems associated with long valve overlap at low speeds. In contrast with FIG. 4A, FIG. 4D illustrates a case of 50° (the amount of retard is measured in crankshaft degrees) retarded camshaft timing coupled with a long duration exhaust event. This combination may advantageously be employed at medium engine loads at low speeds. The 50° retarded camshaft timing produces a very high rate of internal EGR, whereas the long exhaust event is suitable for both low and high speeds at medium load. FIG. 4C illustrates 20° retarded camshaft timing and a short exhaust event. This combination is suitable for light load and low engine speeds. Finally, FIG. 4B illustrates base camshaft timing and long exhaust event. This combination is suitable for high load at wide-open throttle at higher engine speeds. The long exhaust event works well at high speeds and base timing for the camshaft is also desirable at higher load.

While the invention has been shown and described in its preferred embodiments, it will be clear to those skilled in the arts to which it pertains that many changes and modifications may be made thereto without departing from the scope of the invention. For example, those skilled in the art will appreciate in view of this disclosure that the precise combination of camshaft retard and long or short exhaust events may be selected according to the requirements of a vehicle into which an engine is placed. This could require that the camshaft timing be slightly retarded at higher engine speeds and full load.

What is claimed is:

1. A reciprocating four-stroke cycle internal combustion engine having a cylinder block with at least one cylinder, a piston, a crankshaft, a connecting rod joining the piston and the crankshaft, an intake manifold, and intake and exhaust poppet valves servicing the cylinder, with said engine further comprising:

a cylinder head mounted upon the cylinder block so as to close the cylinder;

a camshaft for actuating said intake and exhaust valves;

a camshaft drive for rotating the camshaft and for adjusting the rotational timing of the camshaft with respect to the crankshaft, with the camshaft having a base timing;

a variable exhaust valve operating system for changing the duration of the exhaust valve opening; and a controller for operating the camshaft drive and the exhaust valve operating system so as to control both the timing of the camshaft and the duration of the exhaust valve opening.

2. An engine according to claim 1, wherein the controller operates the camshaft drive and the exhaust valve operating system such that the camshaft timing will generally be retarded at lower to medium engine loads and the exhaust valve will be operated with a relatively shorter duration at lower engine speeds and light loads and with a relatively longer duration at higher engine speeds.

3. An engine according to claim 1, wherein the controller operates the camshaft drive such that the camshaft timing will generally be set at the base timing during operation at high engine loads and retarded at lower and medium engine loads.

4. An engine according to claim 3, wherein the exhaust valve is operated with a relatively shorter duration at lower engine speeds accompanied by either lower or higher loads and with a relatively longer duration at:

low engine speeds accompanied by medium load, and higher engine speeds at all loads.

5. An engine according to claim 3, wherein the exhaust valve is operated with a relatively shorter duration at lower engine speeds accompanied by higher loads and with a relatively longer duration at higher engine speeds.

6. An engine according to claim 1, additionally comprising a charge motion control valve operated by the controller to further modify the angular momentum of charge entering the cylinder.

7. An engine according to claim 6, wherein the charge motion control valve is operated by the controller such that the valve is closed during operation at low to medium loads and opened during operation at higher to full engine loads.

8. An engine according to claim 1, further comprising a pilot mask which directs flow past the intake valve until the intake valve has opened to an extent greater than about 30–40% of its total lift.

9. A method for operating a reciprocating four-stroke cycle internal combustion engine having a cylinder block with at least one cylinder; a cylinder head; a piston; a crankshaft; a connecting rod joining the piston and the crankshaft; an intake manifold; a camshaft; intake and exhaust poppet valves operated by the camshaft; a camshaft drive for rotating the camshaft and for adjusting the rotational timing of the camshaft with respect to the crankshaft; a variable exhaust valve operating system for changing the duration of the exhaust valve opening independently of camshaft timing; and a controller for operating the camshaft drive and the exhaust valve operating system, with said method comprising the steps of:

sensing a plurality of engine operating parameters, including at least engine speed;

determining engine load; and controlling camshaft timing and exhaust valve duration in response to the values of said sensed engine parameters and said determined engine load so as to control the residual fraction of exhaust gas within the engine's cylinder.

10. A method according to claim 9, wherein the camshaft timing is retarded at light and medium loads and advanced at full load.

11. A method according to claim 9, wherein at high load the exhaust valve is operated with a shorter duration at lower engine speeds and with a longer duration at higher engine speeds.

12. A method according to claim 9, wherein the camshaft timing is controlled independently of the duration of the exhaust valve opening event.

13. A reciprocating four-stroke cycle internal combustion engine having a cylinder block with at least one cylinder, a piston, a crankshaft, a connecting rod joining the piston and the crankshaft, an intake manifold, and intake and exhaust poppet valves servicing the cylinder, with said engine further comprising:

a cylinder head mounted upon the cylinder block so as to close the cylinder; a camshaft for actuating said intake and exhaust valves;

a camshaft drive for rotating the camshaft and for adjusting the rotational timing of the camshaft with respect to the crankshaft, with the camshaft having a base timing;

a variable exhaust valve operating system for changing the duration of the exhaust valve opening independently of camshaft timing; and a controller for operating the camshaft drive and the exhaust valve operating system so as to control both the timing of the camshaft and the duration of the exhaust valve opening, with the controller operating the camshaft drive and the exhaust valve operating system such that the camshaft timing will generally be retarded at lower to medium engine loads and the exhaust valve will be operated with a relatively shorter duration at lower engine speeds accompanied by either low or high load and with a relatively longer duration at lower speeds accompanied by medium load and at higher engine speeds at all loads.

14. An engine according to claim 13, wherein the controller operates the camshaft drive and the exhaust valve operating system such that the camshaft timing will generally be retarded at lower to medium engine loads and the exhaust valve will be operated with a relatively shorter duration at lower engine speeds and with a relatively longer duration at higher engine speeds.

15. An engine according to claim 13, wherein said camshaft has three lobes for actuating each exhaust valve, with two of said lobes being for a short duration exhaust event and one of said lobes being for a long duration exhaust event.

* * * * *